US006881909B2

(12) United States Patent
Houck, III

(10) Patent No.: US 6,881,909 B2
(45) Date of Patent: Apr. 19, 2005

(54) FUSE BLOCK WITH INTEGRAL DOOR SENSING ROTARY DISCONNECT

(75) Inventor: Theodore John Houck, III, Milwaukee, WI (US)

(73) Assignee: Rockwell Automation Technologies, Inc., Mayfield Heights, OH (US)

( * ) Notice: Subject to any disclaimer, the term of this patent is extended or adjusted under 35 U.S.C. 154(b) by 0 days.

(21) Appl. No.: 10/714,433

(22) Filed: Nov. 14, 2003

(65) Prior Publication Data

US 2004/0099515 A1 May 27, 2004

Related U.S. Application Data

(63) Continuation-in-part of application No. 10/298,326, filed on Nov. 18, 2002, now Pat. No. 6,700,081.

(51) Int. Cl.[7] ..... H01H 9/22
(52) U.S. Cl. ..... 200/50.13
(58) Field of Search ..... 200/50.12, 50.13, 200/50.15

(56) References Cited

U.S. PATENT DOCUMENTS 1,812,896 A * 7/1931 Olley ..... 200/50.13
3,122,615 A * 2/1964 Chace ..... 200/50.15
3,581,032 A * 5/1971 Christensen ..... 200/50.15
5,493,084 A 2/1996 Whitaker
5,609,244 A 3/1997 Reiter
6,700,081 B1 * 3/2004 Houck, III ..... 200/50.07
6,710,697 B1 * 3/2004 Houck, III ..... 337/196

FOREIGN PATENT DOCUMENTS

DE 1193144 B 5/1965
EP 0564173 A1 6/1993

* cited by examiner

*Primary Examiner*—Neil Abrams
(74) *Attorney, Agent, or Firm*—Quarles & Brady LLP; Alexander M. Gerasimow

(57) ABSTRACT

A fuse block having a rotary operator communicating with a door-mounted knob provides a handle on the rotary operator for engaging the door handle to detect closure of the door. The handle includes first and second coupling mechanisms that control the connection between the handle and the operator depending on whether the door is open or closed. With the door closed power may be connected and disconnected. With the door open the handle may be used only to disconnect power.

32 Claims, 11 Drawing Sheets

FIG. 17
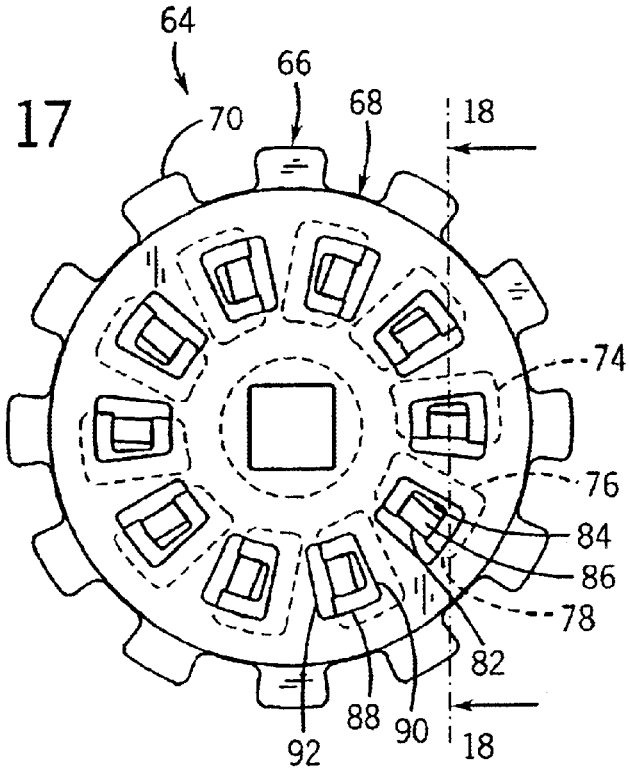
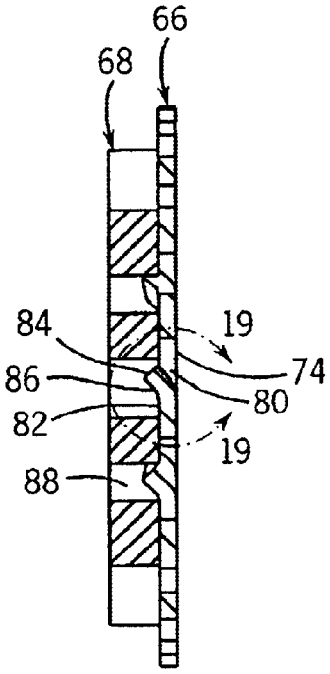
FIG. 18
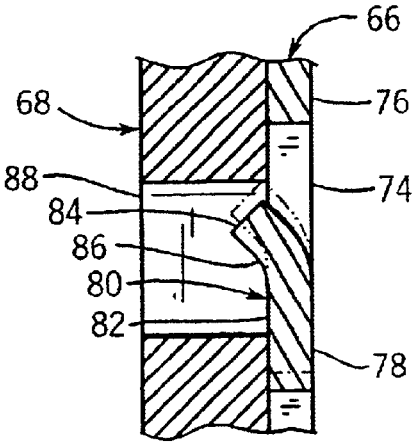
FIG. 19
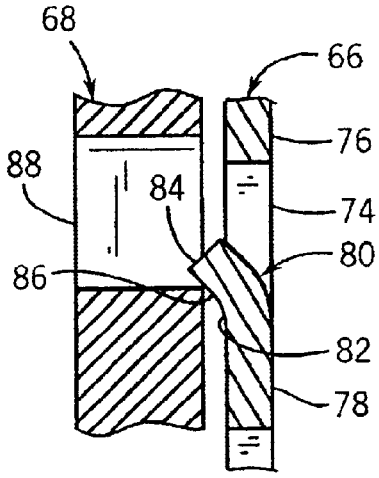
FIG. 20

FUSE BLOCK WITH INTEGRAL DOOR SENSING ROTARY DISCONNECT

CROSS-REFERENCE TO RELATED APPLICATIONS

This application is a Continuation-In-Part of U.S. patent application Ser. No. 10/298,326, filed Nov. 18, 2002, now U.S. Pat. No. 6,700,081 the disclosure of which is hereby incorporated by reference as if set forth in its entirety herein.

STATEMENT REGARDING FEDERALLY SPONSORED RESEARCH OR DEVELOPMENT

BACKGROUND OF THE INVENTION

The present invention relates to electrical fuse blocks for mounting in cabinets and having a forwardly-extending, rotary disconnect operator that may engage a handle on the cabinet door when the cabinet door is closed, and in particular to an improvement in such a fuse block that reduces the chance of accidental operation of the disconnect operator when the cabinet door is open.

Referring to FIG. 1, a standard fuse block 10 of the prior art may receive fuse cartridges 12 along its front face and may attach at its rear face to the rear wall 14 of a metal cabinet 16.

Input terminals along the top of fuse block 10 may receive wires 18 which connect independently to one side of each fuse cartridge 12, the latter which interconnect wires 18 to wires 20 attached to output terminals along the bottom of the fuse cartridge 12. Wires 18, for example, may be connected to a source of three-phase power and wires 20, for example, may be connected to a motor or other piece of equipment.

Fuse block 10 may incorporate a disconnect mechanism (not shown) serving to electrically disconnect wires 18 from the respective fuse cartridges 12. The disconnect mechanism may be controlled by a rotary operator 22 along one side of the fuse block 12 and extending in an orientation perpendicular to the rear wall 14 of cabinet 16 toward an open face of the cabinet.

The open face of the cabinet may be covered by a door 24 attached by hinges to one side of the cabinet 16. Door 24 may support a captively mounted rotary knob 26 having an inwardly extending connector 28.

Referring now to FIG. 2, knob 26 may include connector 28 that extends inwardly through an opening in the door 24. Connector 28 includes retaining flanges 30 for retaining it rotatably within that opening.

When door 24 is closed about the cabinet 16, connector 28 of the knob 26 may engage the outermost end of rotary operator 22, thereby allowing the rotary operator to be operated by knob 26 when door 24 is closed on cabinet 16. Specifically, an inwardly facing end of connector 28 may include a keyway 32 receiving a rectangular end of rotary operator 22 and a pin 34 extending perpendicularly through the rotary operator. Turning knob 26, in turn, rotates operator 22 to electrically disconnect or connect power to wires 20.

Referring again to FIG. 1, knob 26 allows disconnection of power to wires 20 when the door 24 on the cabinet 16 is closed. However, when door 24 is open, rotary operator 22 is exposed, thereby enabling power to be inadvertently reconnected by counter rotation the operator 22.

One apparatus for preventing the reconnection of power while the door is open includes bracketing that is connected to the exterior of fuse block 10. The bracketing enables knob rotation to connect and disconnect the power when the door is closed, and further prevents inadvertent counter rotation of the knob to reconnect the power when the door is open. While this apparatus is suitable for its intended purpose, the bracketing requires modification of an existing fuse block.

It would therefore be desirable to provide a less intrusive mechanism for preventing rotation of the operator in a direction that would reconnected power when the cabinet door is open.

BRIEF SUMMARY OF THE INVENTION

The present invention provides a handle having an integral coupling mechanism that senses the position of the door of the cabinet and lock its disconnect in the open position to prevent inadvertent connection of power when the cabinet door is open. The locking of the disconnect may be overridden when it becomes desirable to reconnect power when the cabinet door is open.

In accordance with one aspect of the invention, a disconnect mechanism is provided for a fuse block receiving power connections and of a type having a support face for mounting on a panel with one or more fuse sockets accessible on a front face of the fuse block opposite the support face. A rotary operator extends outwardly and defines an outer end that is adapted to receive a portion of a door-mounted knob. The operator rotates in a first direction to connect the fuses with the power connections, and rotates in a second direction to disconnect the fuses from the power connections.

The disconnect mechanism includes a rotating handle that receives the outer end of the rotary operator. The handle includes a housing, and a first coupling mechanism that is releasably connected between the operator and the housing. The first coupling mechanism rotates the operator in the first and second directions in response to rotation of the handle in the first and second directions. A second coupling mechanism is connected between the operator and the handle, and includes an engagement member that rotates the operator in the second direction when the handle is rotated in the second direction. The unidirectional engagement member does not rotate the operator when the handle is rotated in the first direction.

The foregoing and other advantages of the invention will appear from the following description. In the description, reference is made to the accompanying drawings which form a part thereof, and in which there is shown by way of illustration, and not limitation, preferred embodiments of the invention. Such embodiments do not necessarily represent the full scope of the invention, and reference should therefore be made to the claims herein for interpreting the scope of the invention.

BRIEF DESCRIPTION OF THE DRAWINGS

FIG. 17 is a top plan view of the ratchet assembly illustrated in FIG. 6;

FIG. 18 is a side elevation view of the ratchet assembly illustrated in FIG. 17 taken along line 18—18 in an engaged position;

FIG. 19 is an enlarged view of the ratchet assembly taken along line 19—19 of FIG. 18;

FIG. 20 is a view of the ratchet assembly similar to FIG. 19, but with the assembly in a disengaged position;

DETAILED DESCRIPTION OF THE PREFERRED EMBODIMENT

Figure 1:
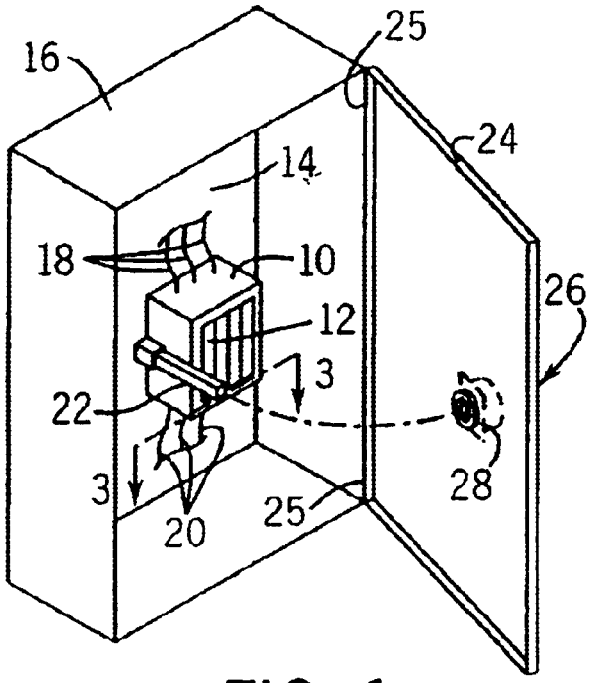
FIG. 1 PRIOR ART
FIG. 1 is a perspective view of a prior art fuse block described above and mounted to the rear of a cabinet and having a forwardly extending rotary disconnect operator that may be received by a door-mounted handle when the cabinet door is closed.
Figure 2:
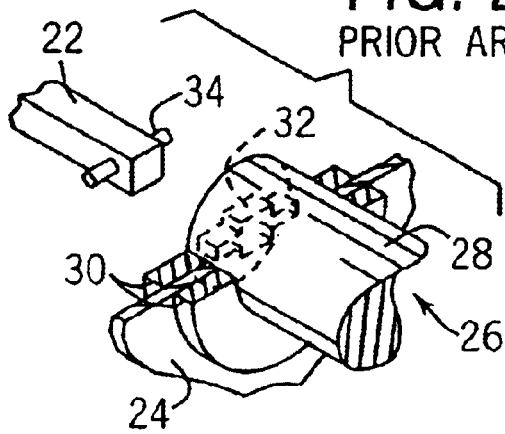
FIG. 2 PRIOR ART
FIG. 2 is a fragmentary view of the door-mounted handle immediately before engagement with the rotary disconnect operator as known in the prior art.
Figures 3, 4:
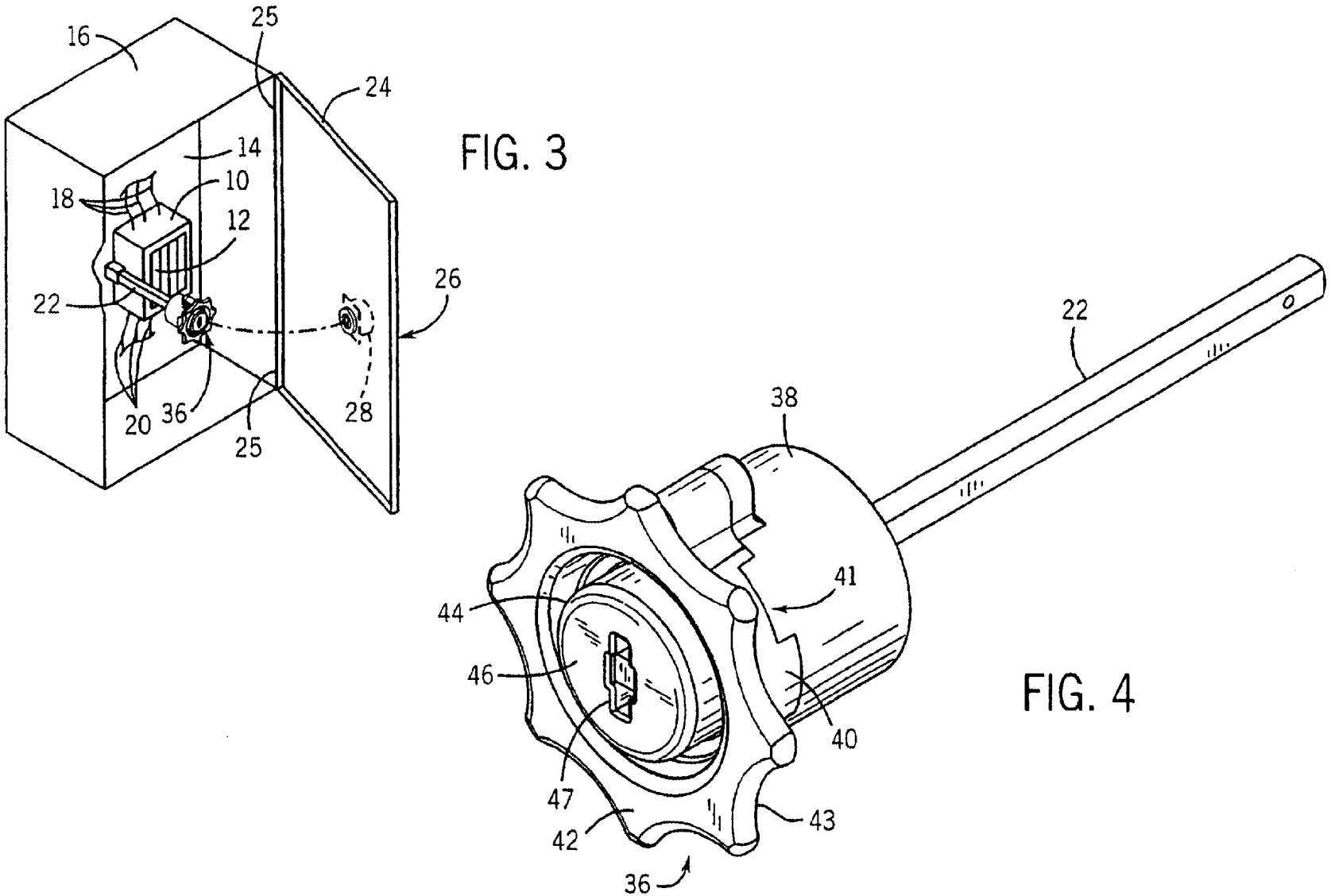
FIG. 3 is a perspective view of a fuse block mounted to the rear of a cabinet and having a forwardly extending rotary disconnect operator extending through a handle constructed in accordance with the preferred embodiment.
FIG. 4 is a perspective view of the handle illustrated in FIG. 3 receiving the operator.

Referring now to FIGS. 3 and 4, the present invention modifies the fuse block 10 described above by mounting a handle 36 onto the axially outer end of rotary operator 22 such that the handle interfaces with the door knob 26, and in particular with connector 28. Handle preferably comprises a plastic, though one skilled in the art will recognize that any material suitable to withstand the stress and strain experienced during operation falls within the scope of the present invention.

Handle 36 includes a housing assembly 41 including an inner housing 38 that is interlocked with an outer housing 40. A flange 42 extends radially outwardly from the axially outer end of housing 40 whose radially outer surface defines a plurality of grooves 43 that are configured to be gripped by a user's hand to facilitate rotation of housing assembly 41 in the clockwise and counterclockwise directions. In accordance with the preferred embodiment, when power is connected, rotation of handle 36 (and operator 22) in the counterclockwise direction disconnects power in fuse block 10. When power is disconnected, rotation of handle 36 (and operator 22) in the clockwise direction reconnects power in the fuse block. It should be appreciated, however, that these directions of rotation can be reversed in accordance with the preferred embodiment to connect and disconnect the power.

Figure 7:
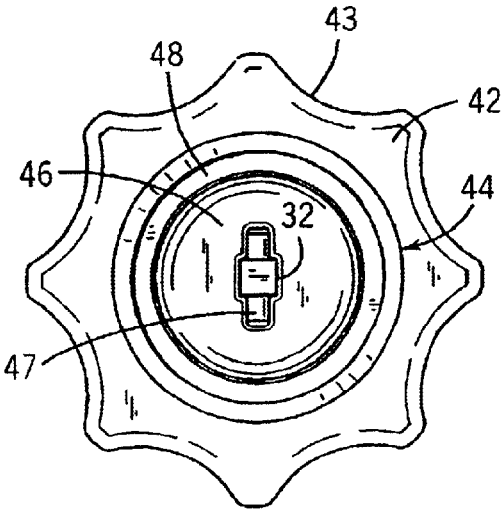
FIG. 7 is a top plan view of the handle illustrated in FIG. 3.

Referring also to FIG. 7, handle 36 further includes an inner hub 44 that is radially surrounded by outer housing 40. Hub 44 further includes an outer face 46 that defines a keyway 47. Keyway 47 receives pin 34 of operator 22, which extends through hub 44 such that the operator 22 and hub 44 can rotate in concert. Inner hub 44 is spring-loaded and can thus be depressed with respect to outer housing 40 and connector 22 when door 24 is closed.

As a result, when door 24 is closed, connector 28 depresses hub 44 relative to operator 22, causing the outer end of operator 22 (including pin 34) to be disposed outwardly from outer face 46. Pin is thus received by keyway 32. Handle 36 includes a primary coupling mechanism that enables operator 22 to rotate clockwise and counterclockwise along with knob 26 to connect and disconnect power in fuse block 10, respectively. Handle 36 further includes a secondary coupling mechanism that enables power to be disconnected by rotating handle 36 counterclockwise in the manner described above when door 24 is open and hub 44 is not depressed. In order to reconnect power when door 24 is open, flange 43, a user can pull housing assembly 41 axially outwardly (or depress hub 44 inwardly) in order to rotate handle 36 clockwise. If housing assembly 41 is not first pulled relative to hub 44, housing assembly 41 will rotate freely in the clockwise direction without rotating hub 44 and operator 22. The secondary coupling mechanism thus prevents power from being inadvertently reconnected by rotating handle 36 clockwise when door 24 is open. The primary and secondary coupling mechanisms will now be described.

Figures 5, 6:
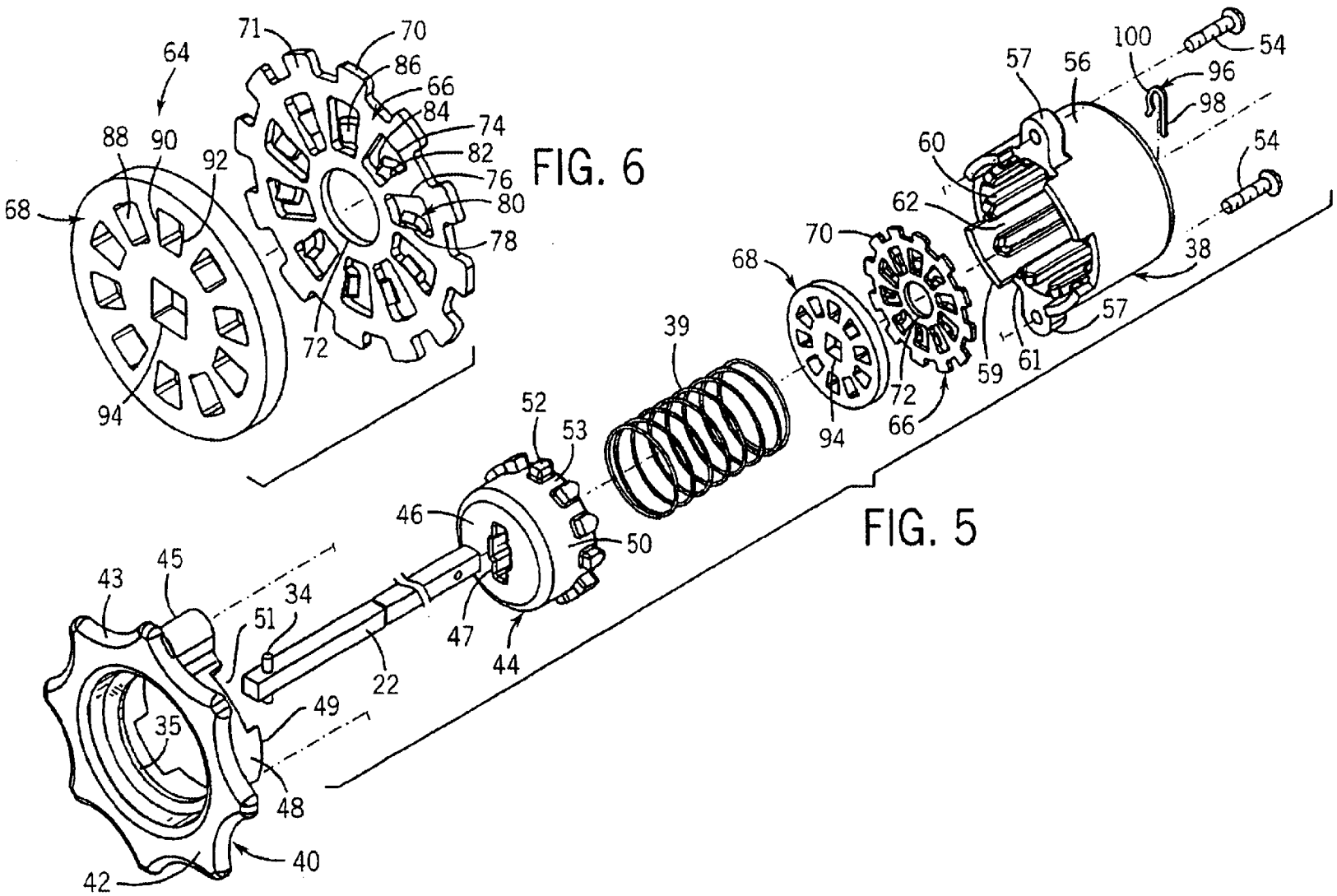
FIG. 5 is an assembly view of the handle illustrated in FIG. 3
FIG. 6 is an assembly view of a ratchet assembly included in the handle illustrated in FIG. 5.

Referring now to FIG. 5, outer housing 40 includes outer flange 42 and an annular neck 48 extending axially inwardly from flange 42. An inner flange 35 extends radially inwardly from neck 48. A pair of threaded apertures 45 extend inwardly from flange 42. Apertures 45 are formed in the radially outer surface of flange 42, and are disposed at radially opposite locations on flange 42. Apertures 45 are sized to receive corresponding screws 54. A plurality of radially spaced notches 49 extends axially inwardly from the inner end of neck 48, and are equally spaced circumferentially about neck 48 such that a corresponding plurality of recesses 51 are interposed between adjacent notches 49.

Hub 44 includes a generally annular body 50 having an outer diameter sized to fit within annular neck 48. A plurality of projections 52 extend radially outwardly from the inner end of body 50. Projections 52 do not extend to outer face 46, and are equally spaced circumferentially about body 50 such that a corresponding plurality of recesses 53 are interposed between adjacent projections. A centrally disposed cylindrical hub 63 (see FIG. 13) extends inwardly from outer face 46, and defines an outer diameter that is slightly less than the inner diameter of a coil spring 39. Spring 39 thus fits over hub 63 and abuts the inner surface of outer face 46. Spring 39 is in compression during operation, and thus configured to bias hub 44 axially outwardly towards outer housing 40.

The outer ends of projections 52 abut the inner end of flange 35 to provide a stop when hub 44 is biased to its outer (non-depressed) position by spring 39. Specifically, flange 35 and outer ends of projections 52 enable rotation of outer housing 40 relative to hub 44.

An aperture 65 extends axially through hub 63, and defines a square cross-section configured to snugly receive operator 22 such that rotation of hub 44 causes operator 22 to also rotate. It should be easily appreciated, however, that operator 22 and aperture 65 could assume cross-sectional shape without departing from the present invention.

Figure 8:
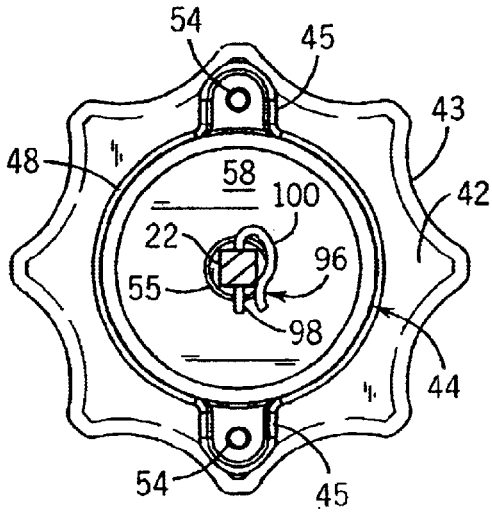
FIG. 8 is a bottom view of the handle illustrated in FIG. 3.

Referring now also to FIG. 8, inner housing 38 includes an annular body 56 closed at its axially inner end by a radial inner face 58. An aperture 55 extends axially through inner face 58, and is centrally disposed to receive operator 22. Aperture 55 is greater than the cross-sectional area of operator 22 such that rotation of inner housing 38 does not directly cause operator 22 to rotate, as will be described in more detail below. A pair of opposing flanges 57 extends radially outwardly from body 56, and includes a pair of apertures that are aligned with apertures 45 of outer housing 40. A plurality of radially spaced notches 59 extends outwardly from the outer end of body 56, and are equally spaced circumferentially about body 56 such that a corresponding plurality of recesses 61 are interposed between adjacent notches. Notches 59 and recesses 61 of inner housing 38 are configured to interlock with recesses 51 and notches 49, respectively, of housing 40.

The outer end of housing 38 is open and can receive hub 44 when hub 44 is depressed, either manually or via connector 28 when door 24 is closed. Specifically, a plurality of axially extending ribs 60 protrudes from the radially inner surface of body 56, and are equally spaced circumferentially about body 56 such that a corresponding plurality of recesses 62 are interposed between adjacent ribs 60. The diameter defined by opposing recesses 62 is slightly greater than the diameter defined by opposing projections 52, and the diameter defined by opposing ribs 60 is slightly greater than the diameter defined by opposing recesses 53.

Accordingly, when hub 44 is received by inner housing 38, ribs 60 and recesses 62 interlock with recesses 53 and projections 52, respectively, thereby causing hub 44 and inner housing 38 (and thus housing assembly 41) to rotate together. As a result, the interlock between hub 44 and inner housing 38 provides a primary coupling mechanism that causes hub 44 and operator 22 to rotate together in both the clockwise and counterclockwise directions. When hub 44 is not depressed and projections 52 and ribs 60 are not interlocked, the primary coupling mechanism is disengaged.

Figure 9:
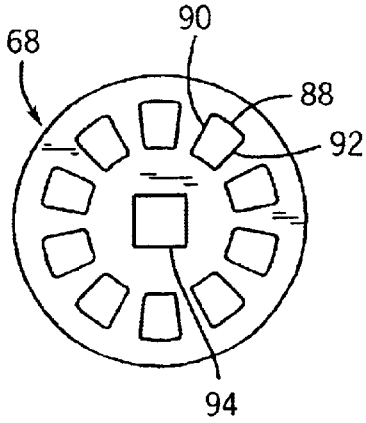
FIG. 9 is a top plan view of a plate forming part of the ratchet assembly illustrated in FIG. 6.
Figure 10:
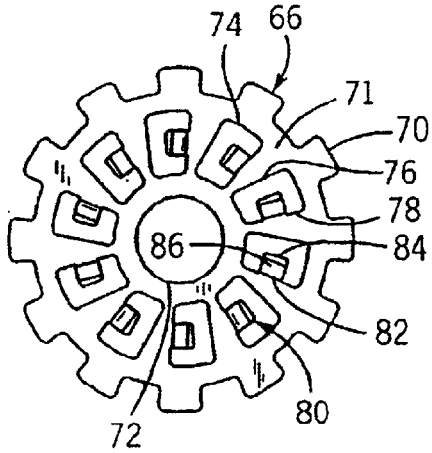
FIG. 10 is a top plan view of a sprocket forming part of the ratchet assembly illustrated in FIG. 6.

Referring now also to FIGS. 6, 9, and 10, handle 36 includes a ratchet assembly 64, which includes a sprocket 66 and a circular disc 68. Sprocket 66 and disc 68 are preferably formed from a metal or could alternatively be formed from a plastic or any alternative material suitable to endure the stress and strain experienced during operation. Sprocket 66 is defined by generally rectangular teeth 70 that extend from a generally flat circular base 71. Teeth 70 are configured to fit into recesses 62 and engage ribs 60 of inner housing 38 such that rotation of inner housing 38 causes sprocket 66 to rotate. Sprocket 66 rests against the outer surface of inner face 58 when installed in housing 38. The axially inner ends of ribs 60 can be slightly thicker than the remaining portion of ribs 60, to provide reinforcement due to the stresses experienced during operation, while still being sufficiently sized to fully receive sprocket 66. A generally circular aperture 72 extends axially through sprocket 66, and is centrally disposed to receive operator 22. Aperture 72 is sized greater than the cross-section of operator 22 such that relative rotation is permitted between sprocket 66 and operator 22.

A plurality of apertures 74 extends through base 71, and are equally spaced radially about aperture 72. Each aperture 74 defines a radially extending leading edge 76 and a trailing edge 78 when sprocket 66 is rotated in the counterclockwise direction. A generally rectangular tooth 80 defines a base 82 that is connected to each trailing edge 78. Teeth 80 extends radially outwardly from the base 82 towards the opposing leading edge 76, and curve axially outwardly toward a distal engaging surface 84. The axially outer surface of each tooth 80 defines a cam surface 86 for disc 68, as will now be described.

In particular, disc 68 includes a plurality of apertures 88 that are radially aligned with the corresponding plurality of teeth 80. Each aperture 88 includes a radially extending leading edge 90 and trailing edge 92 with respect to counterclockwise rotation. Accordingly, referring also to FIGS. 17–20, when the primary coupling mechanism is disengaged and sprocket 66 is rotated counterclockwise, the engaging surface 84 of teeth 80 abut leading edges 90 as illustrated in FIGS. 18–19, thereby causing disc 68 to rotate along with sprocket 66 in the counterclockwise direction. However, when sprocket 66 is rotated clockwise, trailing edges 92 of apertures 88 ride over the cam surface 86 of the corresponding teeth 80 as illustrated in FIG. 20. As a result, disc 68 remains stationary.

A centrally disposed aperture 94 extends axially through disc 68, and defines a cross-section that conforms to the cross section of operator 22. Aperture 94 is sized slightly greater than operator 22, and receives actuator such that rotation of disc 68 causes operator 22 to rotate. It should thus be appreciated that ratchet assembly 64 provides a secondary unidirectional coupling mechanism that, when the primary coupling mechanism is not engaged, permits disc 68 and operator 22 to rotate counterclockwise together with sprocket 66 when the sprocket is rotated counterclockwise. The secondary coupling mechanism also prevents disc 68 and operator 22 from rotating clockwise together when sprocket 66 is rotated clockwise. It should thus be appreciated that the secondary coupling mechanism enables power to be disconnected from fuse block 10 by rotating handle 36 counterclockwise while preventing power from being reconnected by rotating handle 36 clockwise when hub 44 is not depressed (i.e., when door 24 is open).

It should be further appreciated that the positions of sprocket 66 and plate 68 can be reversed such that plate 68 rests against inner face 58, and sprocket 66 rests against the outer face of plate 68. In this orientation, teeth 80 face inwardly to engage apertures 88 in the manner described above.

Referring once again to FIGS. 5 and 8, a clip 96 is provided that includes a pin 98 and a fastener clamp 100. Pin 98 is inserted through an aperture 101 extending radially through operator 22, and is retained by clamp 100 which applies radial pressure against the operator. Pin 98 abuts the inner surface of inner face 58, and thus sets the position of handle 36 relative to operator 22. The axial location of aperture 101 on operator 22 further defines the position of pin 34, and in particular locates the pin 34 in keyway 47 when hub 44 is not depressed.

Figure 11:
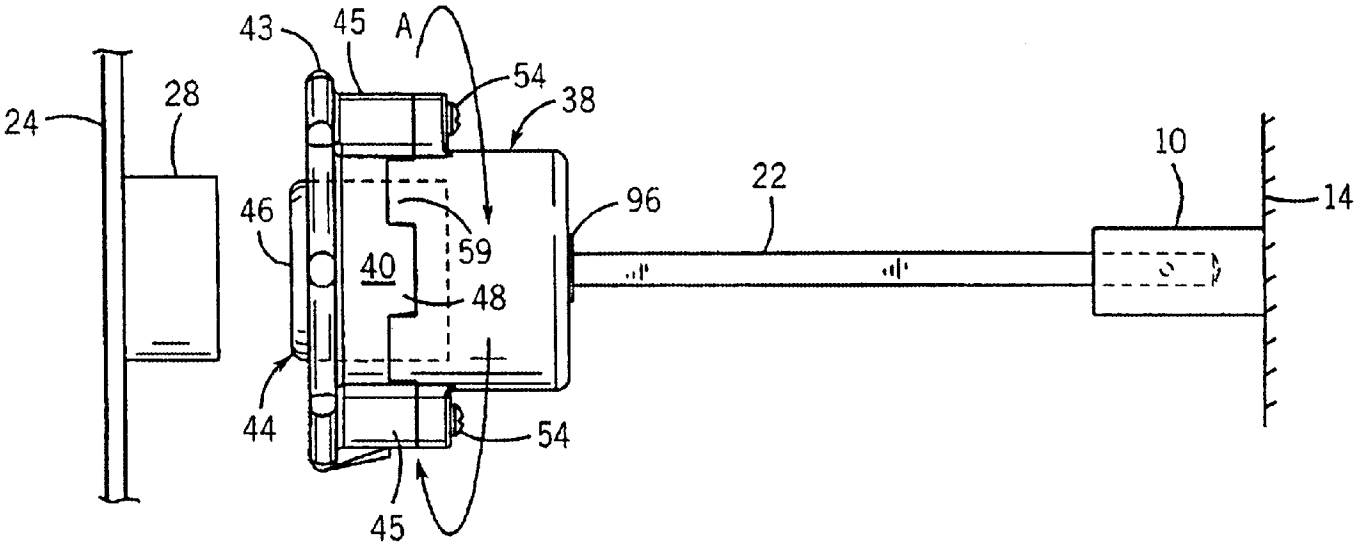
FIG. 11 is a side elevation view of the handle illustrated in FIG. 3 when the door is open.
Figure 13:
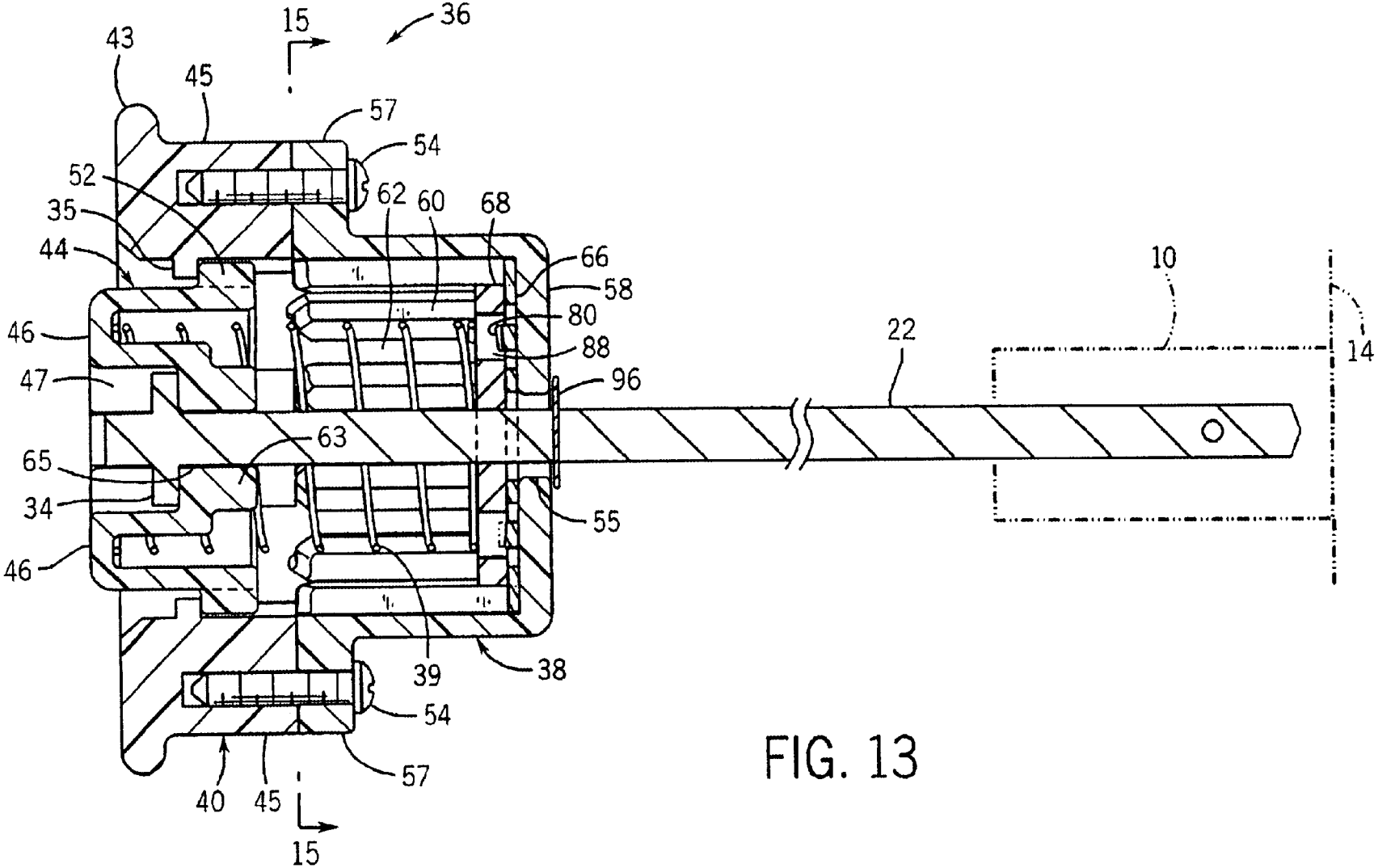
FIG. 13 is a sectional side elevation view of the handle illustrated in FIG. 11.

Operation of handle 36 will now be described with initial reference to FIGS. 11 and 13. In particular, when door 24 is open, and hub 44 is not manually depressed, spring 39 biases hub 44 outwardly such that hub projections 52 are free from engagement with inner housing ribs 60 and the primary coupling mechanism is disengaged. Hub 44 thus senses that the door is open and disengages the primary coupling mechanism.

Figure 16:
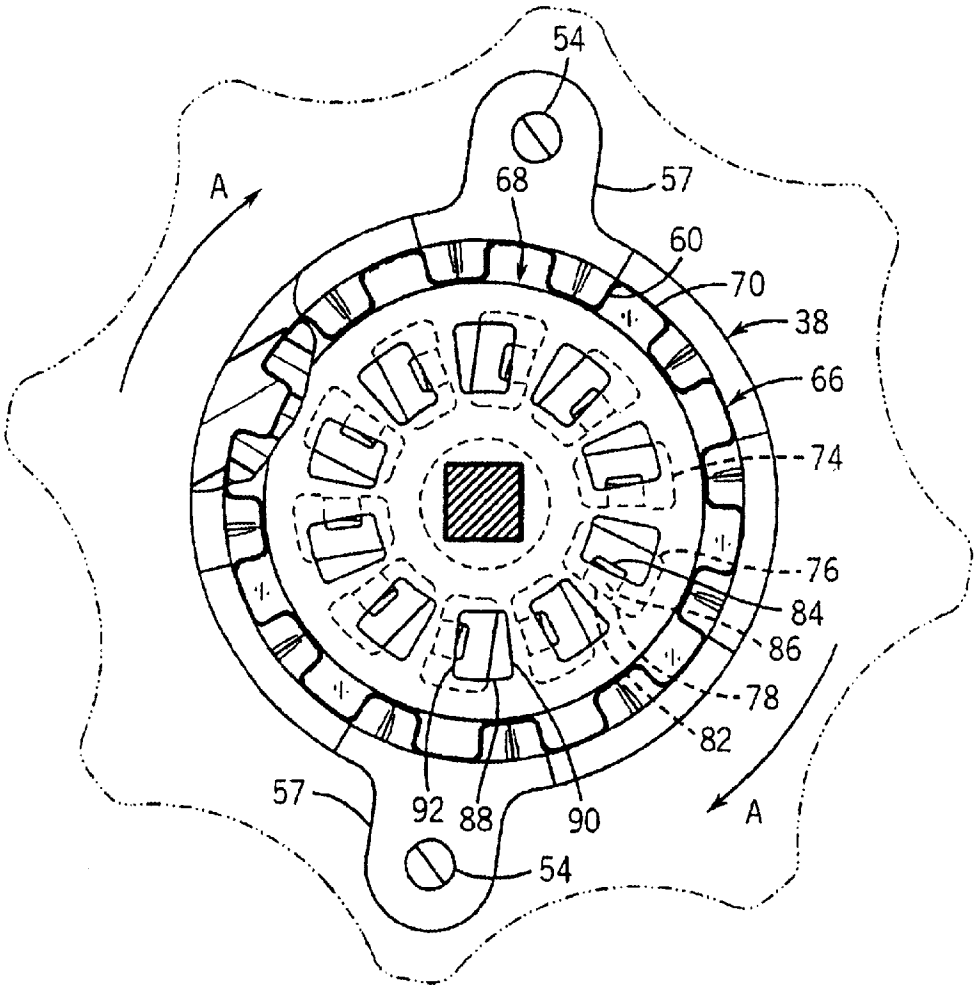
FIG. 16 is a sectional top elevation view of the ratchet assembly similar to FIG. 15, wherein the sprocket is rotated clockwise.
Figure 15:
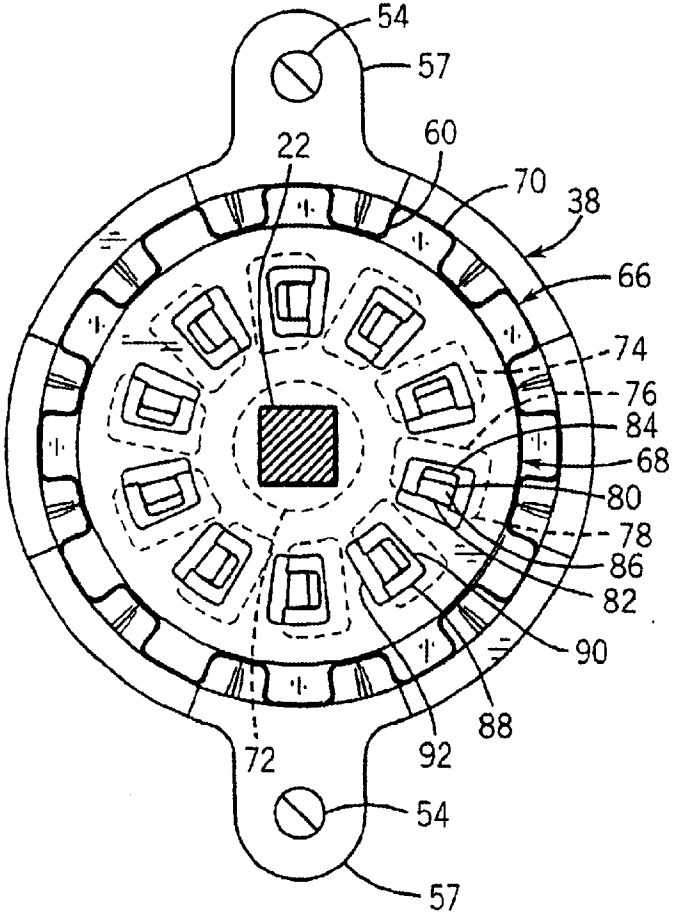
FIG. 15 is a sectional top elevation view of the ratchet assembly illustrated in FIG. 13 taken along line 15—15.

Accordingly, when handle 36 is rotated clockwise in the direction of Arrow A, the secondary coupling mechanism causes housing assembly 41 and sprocket 66 to also rotate clockwise. As described above, housing assembly 41 and sprocket 66 rotate freely relative to operator 22. Furthermore, because trailing edges 92 of apertures 88 of disc 68 ride over the cam surface 86 of the teeth 80 as also illustrated in FIGS. 15–16, disc 68 and operator 22 remain stationary. Power is thus prevented from being reconnected when the door 24 is open and hub 44 is not depressed.

However, if handle 36 is rotated counterclockwise, thus causing sprocket 66 to rotate counterclockwise, the engaging surfaces 84 of teeth 80 cause disc 68 to rotate along with sprocket 66 in the counterclockwise direction. Aperture 94 causes operator 22 to rotate counterclockwise along with disc 68, thereby disconnecting power in fuse block 10.

Figure 21:
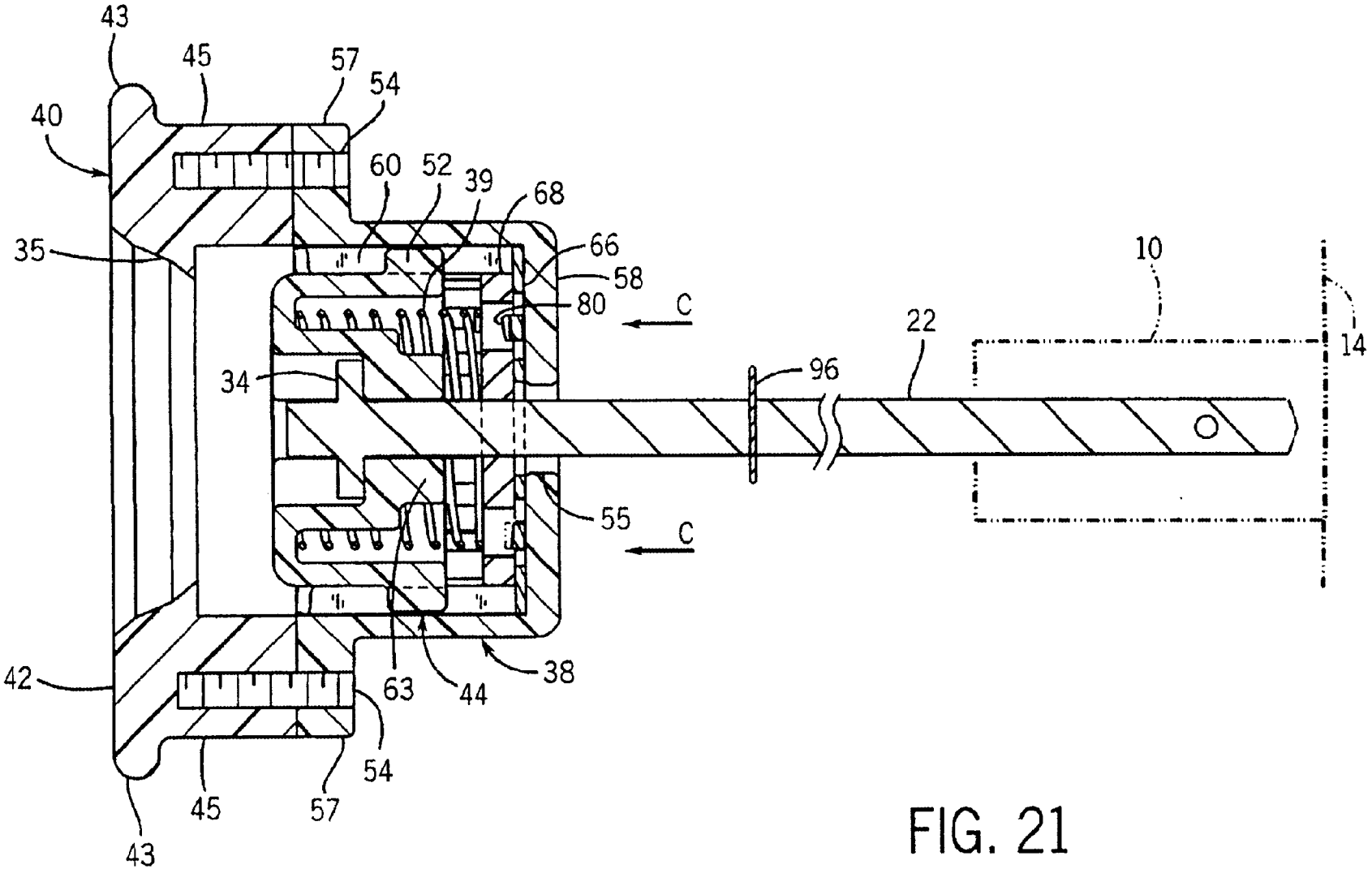
FIG. 21 is a sectional side elevation view of the handle when the door is open after a user has manually activated the primary coupling mechanism.
Figure 22:
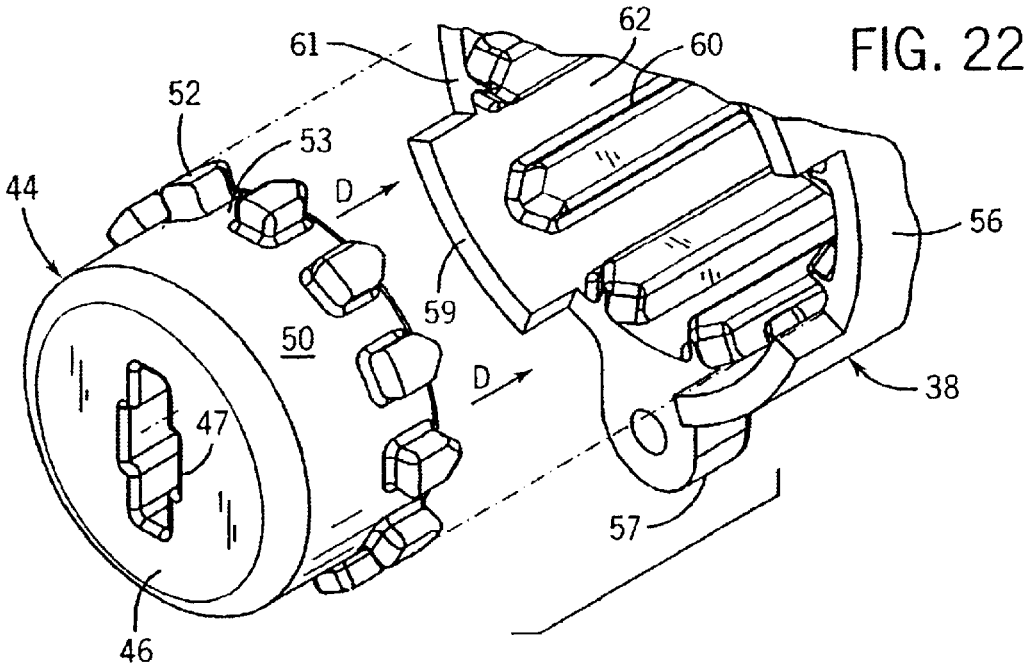
FIG. 22 is a sectional side elevation view of the primary coupling mechanism.
Figure 23:
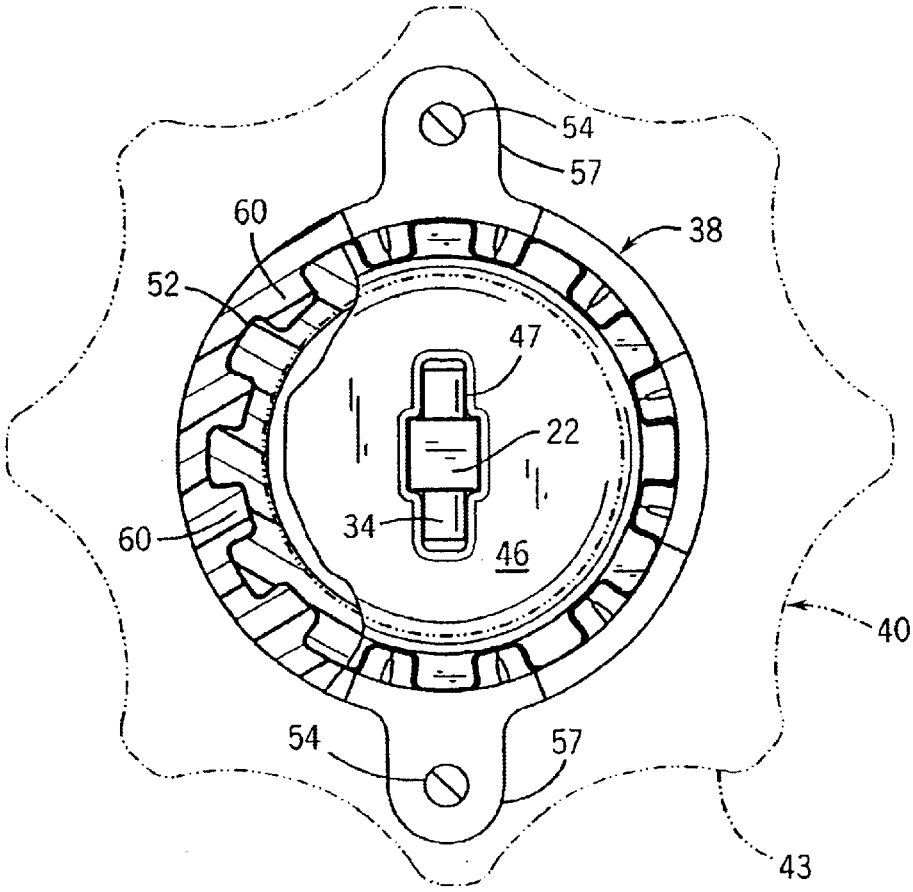
FIG. 23 is a partial sectional elevation view of the handle illustrated in FIG. 21.

Referring now to FIGS. 21–23, when the door 24 is open, grooves 43 can be manually engaged by, for example, a user's fingers to pull housing assembly 41 axially outwardly in the direction of Arrow C against the force of spring 39. The interference between keyway 47 and pin 34 prevents hub 44 from translating outwardly with housing assembly 41. The relative motion between housing assembly 41 and hub 44 causes protrusions 52 to slide between ribs 60 in the direction of Arrow D and become interlocked with respect to rotational motion. Housing assembly 41 and hub 44 thus provide an override that can be manually actuated to engage the primary coupling mechanism when the door 24 is open. Alternatively, it should be appreciated that hub 44 could be depressed against the spring force to engage protrusions 52 and ribs 60. Protrusions 52 and ribs 60 have beveled engaging ends to assist with hub insertion into inner housing 38. Once the protrusions 52 and ribs 60 are interlocked, the primary coupling mechanism is engaged, thereby causing operator 22, which rotates with hub 44, to rotate along with housing assembly 41 in both directions. Because aperture 65 of hub 44 engages operator 22, power can be both connected and disconnected when housing assembly is rotated in the appropriate direction.

Figure 12:
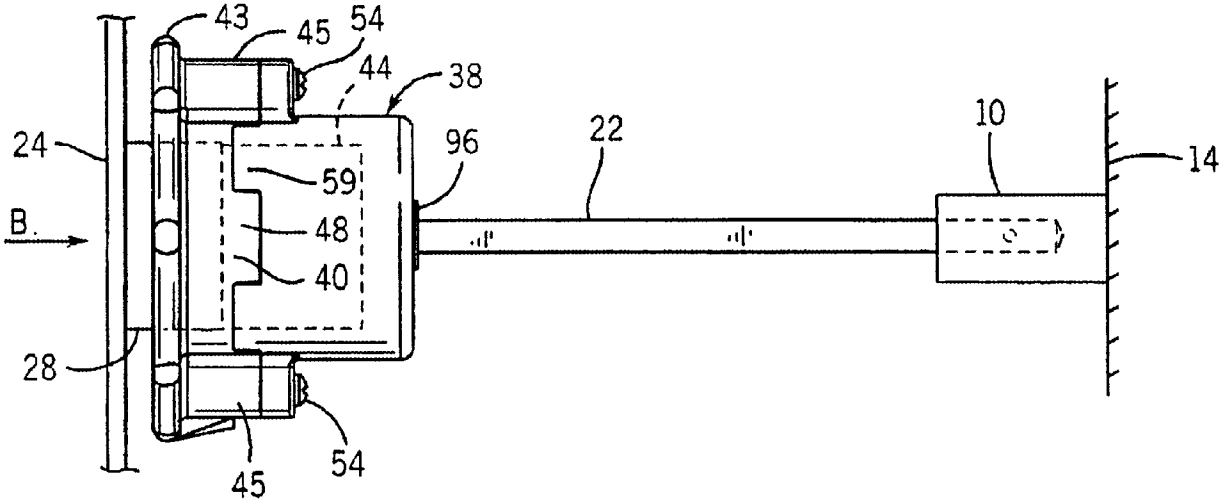
FIG. 12 is a side elevation view of the handle illustrated in FIG. 3 when the door is closed.
Figure 14:
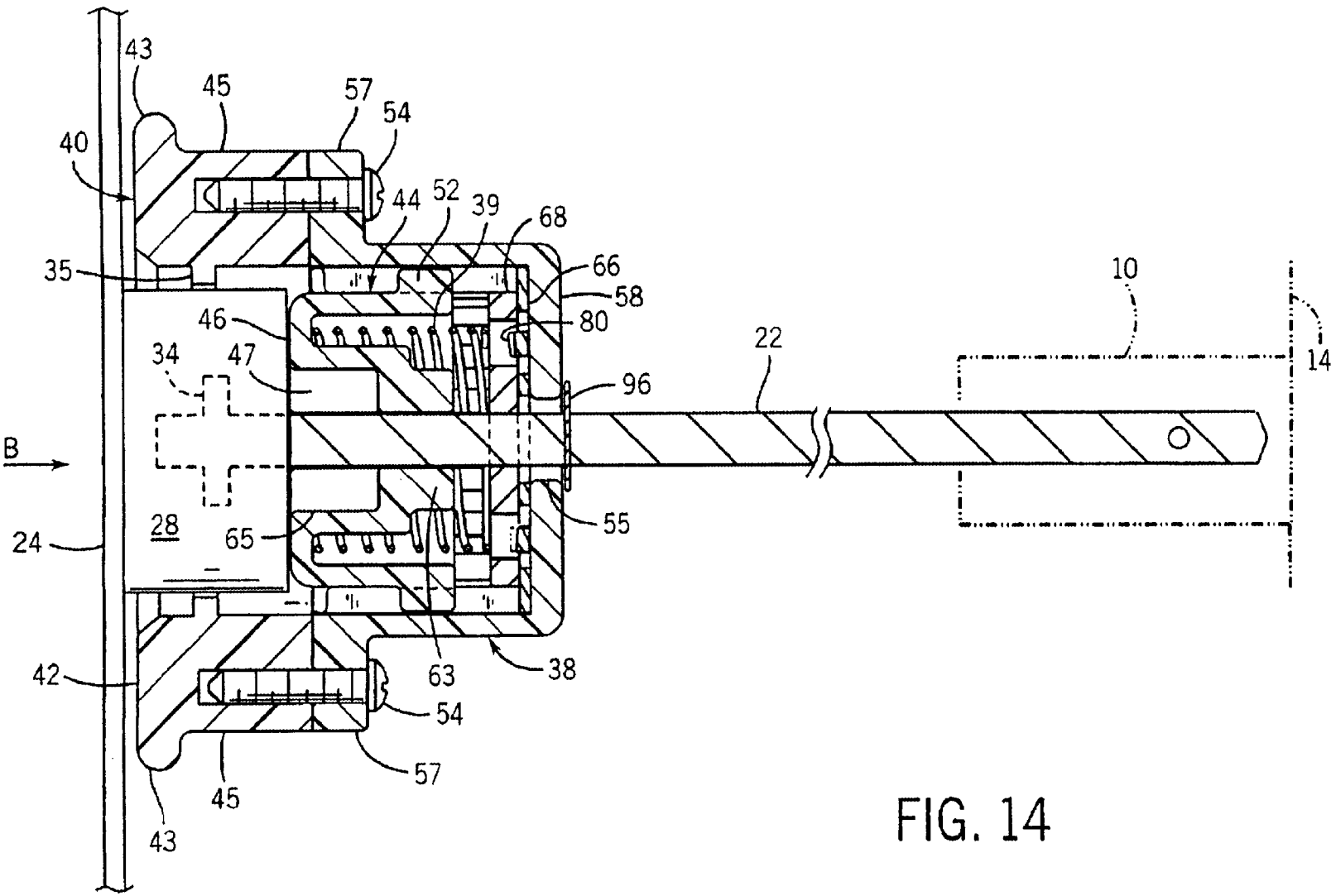
FIG. 14 is a sectional side elevation view of the handle illustrated in FIG. 12.

Referring to FIGS. 12 and 14, when door 24 is closed, hub 44 is depressed inwardly with respect to operator 22 in the direction of Arrow B, thereby exposing pin 34 relative to hub 44. Pin 34 is received by keyway 32 of connector 28. Door knob 26 can then be rotated clockwise and counterclockwise, which causes keyway 32 to bias pin 34 and operator 22 in the direction of knob rotation. Knob 26 thus directly rotates operator 22 to its "on" and "off" positions to connect and disconnect power through fuse block 10.

The present invention thus provides a handle 36 that includes an integral disconnect mechanism that enables power to be connected and disconnected in the fuse block by actuating a traditional doorknob 26 when the door is closed. Handle 36 further enables a user to disconnect, but not reconnect, power when the door is open without first actuating an overriding coupling mechanism. If the overriding coupling mechanism is actuated, a user can disconnect and reconnect power even when door 24 is open. Advantageously, the overriding coupling mechanism is not prone to inadvertent actuation, thereby protecting the user against accidental power connections. Furthermore, because the coupling mechanisms are integral with the handle, modification of existing fuse blocks is not necessary in accordance with the present invention.

The invention has been described in connection with what are presently considered to be the most practical and preferred embodiments. However, the present invention has been presented by way of illustration and is not intended to be limited to the disclosed embodiments. For example, while the present invention is applicable to fuse blocks of the type described above, it should be appreciated that the present invention is applicable to any handle-operated device that would benefit from the integral primary and secondary coupling mechanisms. Accordingly, those skilled in the art will realize that the invention is intended to encompass all modifications and alternative arrangements included within the spirit and scope of the invention, as set forth by the appended claims.

I claim:

1. A disconnect mechanism for a fuse block receiving power connections and of a type having a support face for mounting on a panel with one or more fuse sockets accessible on a front face of the fuse block opposite the support face and with an extending rotary operator, an outer end of the rotary operator adapted to receive a portion of a door-mounted knob and rotating in a first direction to connect the fuses with the power connections, and rotating in a second direction to disconnect the fuses from the power connections, the improvement comprising:

a rotatable handle configured to receive the outer end of the rotary operator, the handle including:

(a) a housing;

(b) a first coupling mechanism that is releasably connected between the operator and the housing, wherein the first coupling mechanism rotates the operator in the first and second directions in response to rotation of the handle in the first and second directions when the first coupling mechanism is connected; and (c) a second coupling mechanism that is connected between the operator and the housing, wherein the second coupling mechanism includes an engagement member that rotates the operator in the second direction when the handle is rotated in the second direction and does not rotate the operator when the handle is rotated in the first direction.

2. The disconnect mechanism as recited in claim 1, wherein the first coupling mechanism includes a hub disposed in the housing that is inwardly depressible relative to the housing to interlock with the housing with respect to rotational motion.

3. The disconnect mechanism as recited in claim 2, wherein the hub includes at least one protrusion that interlocks with at least one corresponding recess in the housing when the hub is depressed.

4. The disconnect mechanism as recited in claim 2, wherein the interlock is disengaged when the hub is not depressed.

5. The disconnect mechanism as recited in claim 4, further comprising a spring member that biases the hub outwardly.

6. The disconnect mechanism as recited in claim 2, wherein the door depresses the hub when the door is closed.

7. The disconnect mechanism as recited in claim 2, wherein the door includes an engaging member that depresses the hub when the door is closed.

8. The disconnect mechanism as recited in claim 1, wherein the second coupling mechanism includes a first rotating member that is rotatably coupled to the housing and a second member that is rotatably coupled to the operator, wherein the second member is rotatably coupled to the first member with respect to rotation of the first member in the second direction.

9. The disconnect mechanism as recited in claim 8, wherein the first rotating member further comprises a sprocket having an outwardly extending tooth.

10. The disconnect mechanism as recited in claim 9, wherein the second rotating member is a disc that defines at least one aperture defining a surface configured to engage the tooth.

11. The disconnect mechanism as recited in claim 10, wherein the tooth is angled with respect to the second rotating member and cams over the surface when the first rotating member is rotated in the first direction, and wherein the tooth engages the surface when the first rotating member is rotated in the second direction.

12. A handle for a fuse block receiving power connections and of a type having a support face for mounting on a panel with one or more fuse sockets accessible on a front face of the fuse block opposite the support face and with an extending rotary operator, an outer end of the rotary operator adapted to receive a portion of a door-mounted knob and rotating to disconnect the fuses from the power connections, the handle comprising:

(a) a housing;

(b) a first coupling mechanism that is releasably connected between the operator and the housing, wherein the first coupling mechanism rotates the operator in the first and second directions in response to rotation of the handle in the first and second directions when the first coupling mechanism is connected; and (c) a second coupling mechanism that is connected between the operator and the housing, wherein the second coupling mechanism includes an engagement member that rotates the operator in the second direction when the handle is rotated in the second direction and does not rotate the operator when the handle is rotated in the first direction.

13. The disconnect mechanism as recited in claim 12, wherein the first coupling mechanism includes a hub disposed in the housing that is inwardly depressible relative to the housing to interlock with the housing with respect to rotational motion.

14. The disconnect mechanism as recited in claim 13, wherein the hub includes at least one protrusion that interlocks with at least one corresponding recess in the housing when the hub is depressed.

15. The disconnect mechanism as recited in claim 13, wherein the interlock is disengaged when the hub is not depressed.

16. The disconnect mechanism as recited in claim 15, further comprising a spring member that biases the hub outwardly.

17. The disconnect mechanism as recited in claim 13, wherein the door depresses the hub when the door is closed.

18. The disconnect mechanism as recited in claim 12, wherein the second coupling mechanism includes a first rotating member that is rotatably coupled to the housing and a second member that is rotatably coupled to the operator, wherein the second member is rotatably coupled to the first member with respect to rotation of the first member in the second direction.

19. The disconnect mechanism as recited in claim 18, wherein the first rotating member further comprises a sprocket having an outwardly extending tooth.

20. The disconnect mechanism as recited in claim 19, wherein the second rotating member is a disc that defines at least one aperture defining a surface configured to engage the tooth.

21. The disconnect mechanism as recited in claim 20, wherein the tooth is angled with respect to the second rotating member and cams over the surface when the first rotating member is rotated in the first direction, and wherein the tooth engages the surface when the first rotating member is rotated in the second direction.

22. A handle usable in combination with a handle-operated device of the type including an outwardly extending operator that is rotatable in a first direction and in a second, opposite direction, the handle comprising:

(a) a housing;

(b) a first coupling mechanism that is releasably connected between the operator and the housing, wherein the first coupling mechanism rotates the operator in the first and second directions in response to rotation of the handle in the first and second directions when the first coupling mechanism is connected; and (c) a second coupling mechanism that is connected between the operator and the housing, wherein the second coupling mechanism includes an engagement member that rotates the operator in the second direction when the handle is rotated in the second direction and does not rotate the operator when the handle is rotated in the first direction.

23. The disconnect mechanism as recited in claim 22, wherein the first coupling mechanism includes a hub disposed in the housing that is inwardly depressible relative to the housing to interlock with the housing with respect to rotational motion.

24. The disconnect mechanism as recited in claim 23, wherein the hub includes at least one protrusion that interlocks with at least one corresponding recess in the housing when the hub is depressed.

25. The disconnect mechanism as recited in claim 23, wherein the interlock is disengaged when the hub is not depressed.

26. The disconnect mechanism as recited in claim 25, further comprising a spring member that biases the hub outwardly.

27. The disconnect mechanism as recited in claim 23, wherein a door depresses the hub when the door is closed.

28. The disconnect mechanism as recited in claim 23, wherein the door includes an engaging member that depresses the hub when the door is closed.

29. The disconnect mechanism as recited in claim 22, wherein the second coupling mechanism includes a first rotating member that is rotatably coupled to the housing and a second member that is rotatably coupled to the operator, wherein the second member is rotatably coupled to the first member with respect to rotation of the first member in the second direction.

30. The disconnect mechanism as recited in claim 29, wherein the first rotating member further comprises a sprocket having an outwardly extending tooth.

31. The disconnect mechanism as recited in claim 30, wherein the second rotating member is a disc that defines at least one aperture defining a surface configured to engage the tooth.

32. The disconnect mechanism as recited in claim 31, wherein the tooth is angled with respect to the second rotating member and cams over the surface when the first rotating member is rotated in the first direction, and wherein the tooth engages the surface when the first rotating member is rotated in the second direction.

* * * * *